US006158158A

United States Patent [19]

Wagner

[11] Patent Number: 6,158,158

[45] Date of Patent: Dec. 12, 2000

[54] METHOD OF FRICTIONALLY BONDING A LINER TO AN OUTER TUBE OF A WEAPON BARREL

[75] Inventor: Hartmut Wagner, Unterlüss, Germany

[73] Assignee: Rheinmetall W & M GmbH, Unterlüss, Germany

[21] Appl. No.: 09/245,924

[22] Filed: Feb. 8, 1999

[30] Foreign Application Priority Data

Feb. 6, 1998 [DE] Germany ..... 198 04 651

[51] Int. Cl.[7] ..... F41A 21/04

[52] U.S. Cl. ..... 42/76.02; 89/16; 29/1.11

[58] Field of Search ..... 42/76.01, 76.02; 89/14.05, 16; 29/1.1, 1.11

[56] References Cited

U.S. PATENT DOCUMENTS 1,514,166 11/1924 Morgan et al. ..... 29/1.11

5,214,234 5/1993 Divecha et al. ..... 89/16

FOREIGN PATENT DOCUMENTS 579043 7/1959 Canada ..... 42/76.02

*Primary Examiner*—Stephen M. Johnson

*Attorney, Agent, or Firm*—Venable; Gabor J. Kelemen

[57] ABSTRACT

A method of frictionally bonding a liner to a length portion of an outer tube of a weapon barrel includes the following steps: Cooling the liner to a temperature of less than −50° C.; heating the length portion of the outer tube to a temperature such that the inner diameter of the outer tube becomes greater than the outer diameter of the liner; introducing the liner into the outer tube while maintaining the temperature of the outer tube constant; and discontinuing the heating of the outer tube and cooling the outer tube such that shrinkage of the outer tube onto the liner first occurs along a central length portion of the liner, followed, after a predetermined period, by a shrinkage of the outer tube onto the liner along terminal length portions of the liner which flank its central length portion.

11 Claims, 3 Drawing Sheets

METHOD OF FRICTIONALLY BONDING A LINER TO AN OUTER TUBE OF A WEAPON BARREL

CROSS REFERENCE TO THE RELATED APPLICATION

This application claims the priority of German Application No. 198 04 651.0 filed Feb. 6, 1998, which is incorporated herein by reference.

BACKGROUND OF THE INVENTION

This invention relates to a method of providing a friction bond between a liner and the inner wall face of an outer tube of a weapon barrel by means of a shrinking process.

To be able to reuse worn weapon barrels, it has been long known to re-drill the barrel and line it with a not self-supporting tube such as described, for example, in the "Handbook on Weaponry", second English edition, published in 1992 by Rheinmetall GmbH, Düsseldorf, Germany; pages 322–324. The inner tube (liner) is bonded to the inner face of the outer tube, for example, by means of a shrinking process which includes the steps of heating the outer tube and water-cooling the liner.

Particularly when liners of a large length/diameter ratio are used, the conventional process has been found to be disadvantageous since the bonding clearance between the liner and the outer tube is very small because during the heat shrinking process a maximum temperature of the outer tube must not be exceeded. Furthermore, risks are not insubstantial that the internal stress conditions of the barrel are destroyed.

SUMMARY OF THE INVENTION

It is an object of the invention to provide an improved method of friction bonding to one another a relatively long and thin-walled liner to an outer tube of a weapon barrel in a simple and very accurate manner.

This object and others to become apparent as the specification progresses, are accomplished by the invention, according to which, briefly stated, the method of frictionally bonding a liner to a length portion of an outer tube of a weapon barrel includes the following steps: Cooling the liner to a temperature of less than −50° C.; heating the length portion of the outer tube to a temperature such that the inner diameter of the outer tube becomes greater than the outer diameter of the liner; introducing the liner into the outer tube while maintaining the temperature of the outer tube constant; and discontinuing the heating of the outer tube and cooling the outer tube such that shrinkage of the outer tube onto the liner first occurs along a central length portion of the liner, followed, after a predetermined period, by a shrinkage of the outer tube onto the liner along terminal length portions of the liner which flank its central length portion.

The invention is based on the principle according to which the joining clearance between the liner and the outer tube is enlarged by cooling the liner to a temperature below −50° C., preferably to −70° C. in addition to heating the outer tube.

If the liner, upon introduction into the outer tube, is first further cooled then the shrinking process first proceeds advantageously slowly because a heating of the outer tube (the component to be shrunk) does not lead to any immediate significant heating of the liner and thus also does not cause a significant diameter increase thereof.

For cooling the liner, the latter is preferably filled with dry ice. In case such a cooling is not performed in vacuum or in a space filled with a protective gas, the liner has to be protected from the humidity of environmental air by providing an insulating layer at its exterior by during the cooling process.

The heating and cooling of the outer tube is controllable sectionwise in such a manner that the outer tube is first shrunk onto the liner along a central length portion of the liner, and shrinkage along the remaining length portions of the liner (that is, along the length portions which flank the central length portion) takes place only after a certain delay.

DESCRIPTION OF THE PREFERRED EMBODIMENT

Figure 1:
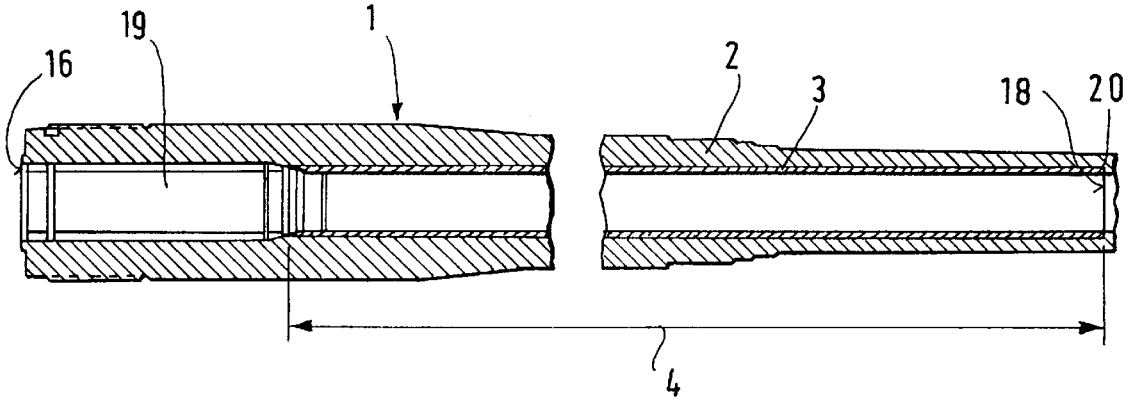
FIG. 1 is an axial sectional view of a weapon barrel in which the liner has been friction bonded to the inner wall face of the outer tube by a shrinking process according to the invention.

FIG. 1 shows a weapon barrel 1 of a tank cannon. The barrel 1 is formed of an outer tube (jacket tube) 1 and a thin-walled liner 3 which is arranged along a length portion 4 of the outer tube 2 and is coupled therewith by a shrinking process according to the invention to be described below. The length portion 4 which is a highly stressed part of the weapon barrel during operation, is hereafter also referred to as the joining region.

Figure 2:
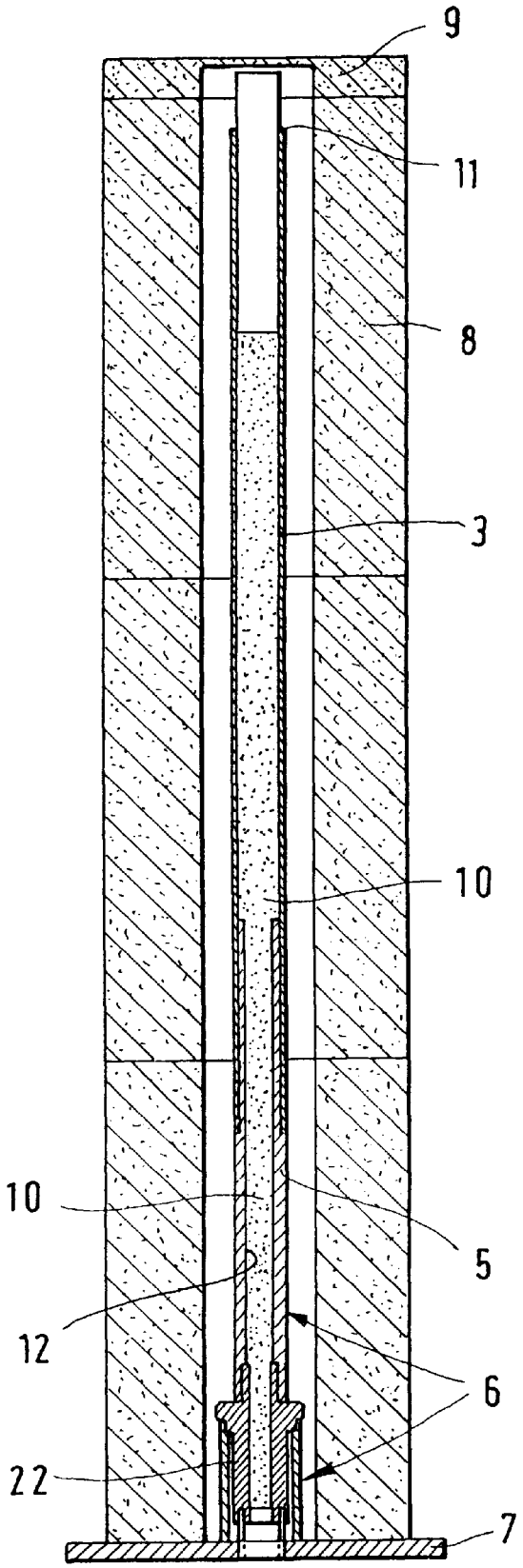
FIG. 2 is an axial sectional view on a reduced scale of a liner supported on a mandrel and undergoing a cooling process.

Turning to FIG. 2, to friction bond the liner 3 to the outer tube 2 in accordance with the invention, first the liner 3 is supported in a vertical orientation on a positioning mandrel 5 mounted on a stand 6 having a base plate 7. To protect the liner 3 from icing during the cooling process, Styrofoam blocks 8 are provided circumferentially about the liner 3, closed on the top by a Styrofoam cap 9.

As a next step, the liner 3 and the axial bore 12 of the positioning mandrel 5 are filled with dry ice 10 by a charging pipe 11. In this manner a uniform cooling over the entire length of the liner 3 is ensured. Dependent on the wall thickness and the material of the liner, approximately up to a three-hour exposure is needed for a satisfactory thorough cooling of the liner 3 to a temperature of −70° C.

Simultaneously with the cooling of the liner 3, a heating of the outer tube 2 to approximately 335° C. (±5° C.) is effected. To ensure that the entire joining region 4 is sufficiently heated, the heated region of the outer tube 2 is extended on either side of the joining zone 4 proper by approximately 0.5 m. The heating rate should be approximately between 20° C. and 30° C. per hour to ensure a sufficient overall heating of the outer tube 2. In practice an inductive heating by means of a suitable heater 13 (FIG. 3) has been proved advantageous.

Figure 3:
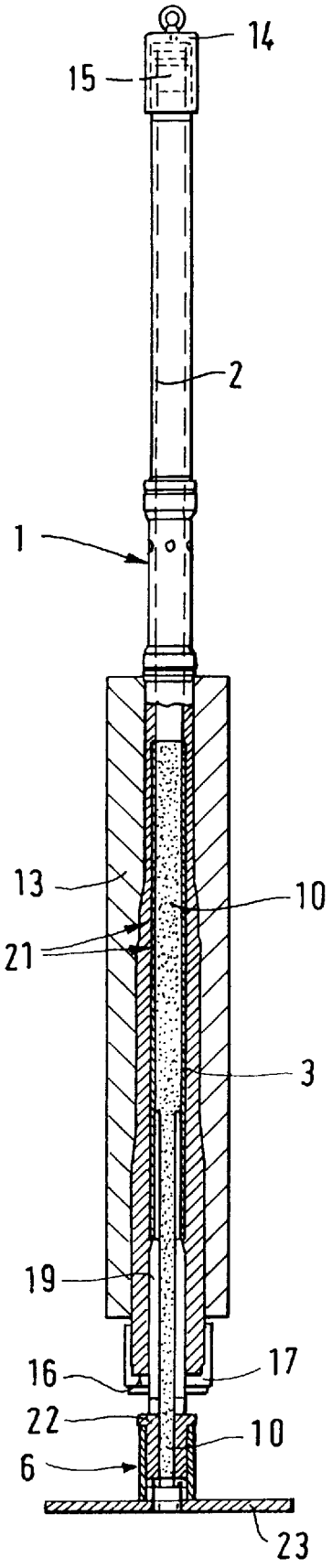
FIG. 3 is an axial sectional view of an assembly comprising an outer tube pushed on the liner and depicted during the shrinking process.

After the outer tube 2 and the liner 3 have reached their condition suitable for insertion, that is, the inner diameter of the outer tube 2 has become suitably larger than the outer diameter of the liner 3, the outer tube 2, while continuing its heating, is lifted by a hoisting device 14 by the barrel muzzle 15 and is positioned over the charging tube 11 and the liner 3 still surrounded by the Styrofoam blocks 8. In this procedure, for simplifying the positioning of the outer tube 2, a guiding funnel 17 may be arranged at the breech side end 16 of the outer tube 2 as shown in FIG. 3.

The Styrofoam blocks 8 and the charging tube 11 are thereafter removed, the liner 3 is cleaned dry and is lightly wetted with a solid lubricant, for example, molybdenum disulfide ($MOS_2$).

Thereafter the outer tube 2 is lowered to the level of the upper end 18 of the liner 3 for testing and adjusting the alignment between the outer tube 2 and the liner 3. After a correct positioning is determined, the lowering of the outer tube 2 is continued until the upper end 18 of the liner 3, after passing the chamber 19 of the outer tube 2, abuts against a radially inward oriented projection 20 of the outer tube 2, as shown in FIG. 1.

As a next step, the heating of the middle zone 21 of the joining region 4 is discontinued, for example, by de-energizing and removing a heater element associated with the middle zone 21, and the middle zone 21 is cooled by air. Simultaneously a plug 22 may be removed from the lower end 23 of the stand 6 to remove the residual dry ice 10 and to permit the liner 3 to more rapidly warm up to the temperature of the outer tube 2.

When the outer tube 2 in the middle region 21 has cooled to approximately 100° C., the heat is turned off and the entire outer tube is cooled by air. Such a stepwise cooling has the effect that the outer tube 2 holds first the liner 3 in its mid region 21 firmly and thereafter is shrunk along the remaining length portions on both sides of the partial region 21 on the liner 3. Such a procedure prevents cracks in the transitional region between the liner 3 and the frontal caliber length portion of the outer tube 2 as the latter longitudinally contracts.

After the temperature of the outer tube 2 has dropped to approximately 50° C., the weapon barrel 1 may be lifted off the stand 6 by means of the hoist 14 and may be installed in the weapon.

It will be understood that the above description of the present invention is susceptible to various modifications, changes and adaptations, and the same are intended to be comprehended within the meaning and range of equivalents of the appended claims.

What is claimed is:

1. A method of frictionally bonding a liner to a length portion of an outer tube of a weapon barrel, comprising the following steps:

(a) providing an outer tube having an inner diameter;

(b) providing a liner having an outer diameter, a central length portion and two terminal length portions flanking said central length portion;

(c) cooling the liner to a temperature of less than −50° C.;

(d) heating said length portion of said outer tube to a temperature such that said inner diameter of said outer tube becomes larger than said outer diameter of said liner;

(e) introducing said liner into said outer tube while maintaining the temperature of said outer tube constant; and (f) discontinuing step (d) and cooling said outer tube such that shrinkage of said outer tube onto said liner first occurs along said central length portion of said liner, followed, after a predetermined period, by a shrinkage of said outer tube onto said liner along said terminal length portions of said liner.

2. The method as defined in claim 1, wherein step (f) comprises of the consecutive steps of (1) discontinuing heating said outer tube along said central length portion of said liner;

(2) cooling said outer tube along said central length portion of said liner until the temperature of said outer tube along said central length portion has dropped to a predetermined value;

(3) discontinuing heating said outer tube along said terminal portions of said liner; and (4) cooling said outer tube in its entirety.

3. The method as defined in claim 1, further comprising the step of positioning, prior to step (e), said liner on a mandrel in a vertical orientation; and further wherein step (e) comprises the steps of positioning said outer tube above said liner and subsequently pushing said outer tube onto said liner.

4. The method as defined in claim 1, wherein step (c) comprises the step of filling said liner with dry ice.

5. The method as defined in claim 1, wherein said temperature in step (c) is −70° C.

6. The method as defined in claim 1, further comprising the step of surrounding said liner, for a duration of step (c), with an insulating body for protecting said liner from precipitation by moisture contained in air.

7. The method as defined in claim 1, wherein step (d) comprises the step of inductive heating.

8. The method as defined in claim 1, wherein step (d) comprises the step of heating said length portion of said outer tube to a temperature between 330 and 340° C.

9. The method as defined in claim 1, wherein step (d) comprises the step of heating said outer tube at a heating rate of between 20 and 30° C. per hour.

10. The method as defined in claim 1, wherein step (f) comprises the step of cooling said outer tube with air.

11. The method as defined in claim 1, further comprising the step of applying, immediately before step (e), a molybdenum disulfide layer to an external surface of said liner.

* * * * *